US009129522B2

(12) United States Patent
Kwon et al.

(10) Patent No.: US 9,129,522 B2
(45) Date of Patent: Sep. 8, 2015

(54) TRAFFIC SPEED ESTIMATION USING TEMPORAL AND SPATIAL SMOOTHING OF GPS SPEED DATA

(71) Applicant: ITERIS, INC., Santa Ana, CA (US)

(72) Inventors: Jaimyoung Kwon, Berkeley, CA (US); Karl F. Petty, Berkeley, CA (US); Alex A. Kurzhanskiy, Albany, CA (US); Andrew J. Moylan, Berkeley, CA (US)

(73) Assignee: ITERIS, INC., Santa Ana, CA (US)

( * ) Notice: Subject to any disclaimer, the term of this patent is extended or adjusted under 35 U.S.C. 154(b) by 0 days.

(21) Appl. No.: 14/321,754

(22) Filed: Jul. 1, 2014

(65) Prior Publication Data

US 2015/0006068 A1 Jan. 1, 2015

Related U.S. Application Data

(60) Provisional application No. 61/841,450, filed on Jul. 1, 2013.

(51) Int. Cl.

| | |
|---|---|
| ***G08G 1/00*** | (2006.01) |
| ***G06G 7/76*** | (2006.01) |
| ***G08G 1/01*** | (2006.01) |
| ***G08G 1/0967*** | (2006.01) |

(52) U.S. Cl.

CPC ..... *G08G 1/0133* (2013.01); *G06G 7/76* (2013.01); *G08G 1/0112* (2013.01); *G08G 1/096716* (2013.01); *G08G 1/20* (2013.01)

(58) Field of Classification Search

USPC ..... 701/117, 119, 423, 532; 340/995.13, 340/905, 992

See application file for complete search history.

(56) References Cited

U.S. PATENT DOCUMENTS

| | | | | |
|---|---|---|---|---|
| 8,793,063 | B2 * | 7/2014 | Horvitz et al. | 701/119 |
| 2005/0240340 | A1 * | 10/2005 | Ishikawa et al. | 701/117 |
| 2006/0064233 | A1 * | 3/2006 | Adachi et al. | 701/117 |
| 2006/0074544 | A1 * | 4/2006 | Morariu et al. | 701/117 |
| 2006/0082472 | A1 * | 4/2006 | Adachi et al. | 340/995.13 |
| 2008/0183376 | A1 * | 7/2008 | Knockeart et al. | 701/119 |
| 2008/0208441 | A1 * | 8/2008 | Cheung | 701/117 |

(Continued)

FOREIGN PATENT DOCUMENTS

| | | | |
|---|---|---|---|
| GB | PCT/GB01/05220 | * | 11/2001 |
| WO | PCT/US03/41207 | * | 6/2005 |

OTHER PUBLICATIONS

Moukas, et al., "Trafficopter: A Distributed Collection System for Traffic Information", Jul. 1998, 11 Pages.*

(Continued)

*Primary Examiner* — Cuong H Nguyen
(74) *Attorney, Agent, or Firm* — Lazaris IP

(57) ABSTRACT

Estimation of traffic speed includes applying data processing functions to determine missing speed information by smoothing spatial and temporal GPS data to achieve an accurate estimation of link speed over all links of a transportation network at all time periods. This estimation of traffic speed uses one link's observed speed information to estimate neighboring links without observed speed information and therefore provides a system and method of processing collected GPS data to obtain a thorough understanding of traffic flow conditions for all represented links without further collection of GPS data. The present invention also provides a framework for analyzing and improving real-time collection of GPS speed data.

25 Claims, 1 Drawing Sheet

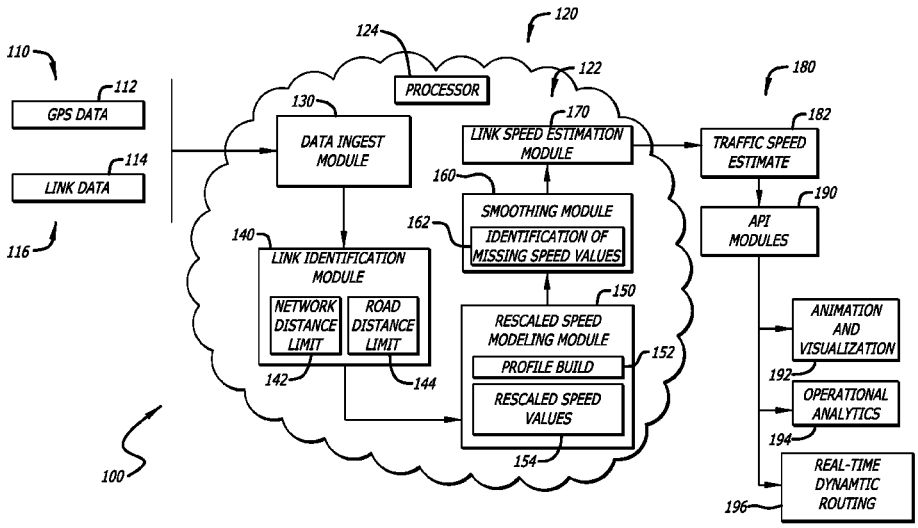

(56) References Cited

U.S. PATENT DOCUMENTS

| | | | | |
|---|---|---|---|---|
| 2009/0326791 | A1* | 12/2009 | Horvitz et al. | 701/119 |
| 2011/0160988 | A1* | 6/2011 | Rogers | 701/119 |
| 2013/0073193 | A1* | 3/2013 | Heavey | 701/119 |
| 2013/0124074 | A1* | 5/2013 | Horvitz et al. | 701/119 |
| 2014/0244148 | A1* | 8/2014 | Horvitz et al. | 701/118 |

OTHER PUBLICATIONS

Shashi Shekhar and Andrew Fetterer. "Genesis: An Approach to Data Dissemination in Advanced Traveler Information Systems," Nov. 1994, 7 pages.*

Sweeney, Jr., "An Overview of Intelligent Vehicle Highway Systems (IVHS)", WESCON 93 Conf, Sep. 1993, 5 pages.*

Pang, et al., "Adaptive route selection for dynamic route guidance system based on fuzzy-neural approaches", Nov. 1999, p. 76-82, Hitachi Research Laboratory Hitachi, Ltd. Japan.*

GPS roadside integrated precision positioning system; Hohman, D.; Murdock, T.; Westerfield, E.; Hattox, T.; Kusterer, T. Position Location and Navigation Symposium, IEEE 2000; Year: 2000; pp. 221-230, DOI: 10.1109/PLANS.2000.838306.*

Efficient Traffic State Estimation for Large-Scale Urban Road Networks; Qing-Jie Kong; Qiankun Zhao; Chao Wei; Yuncai Liu Intelligent Transportation Systems, IEEE Transactions on; Year: 2013, vol. 14, Issue: 1; mpp. 398-407, DOI: 10.1109/TITS.2012.2218237.*

Robust road link speed estimates for sparse or missing probe vehicle data; Widhalm, P.; Piff, M.; Brandle, N.; Koller, H.; Reinthaler, M.; Intelligent Transportation Systems (ITSC), 2012 15th International IEEE Conference on; Year: 2012 pp. 1693-1697, DOI: 10.1109/ITSC.2012.6338906.*

Short-Term Traffic Speed Forecasting Based on Data Recorded at Irregular Intervals; Qing Ye; Szeto, W.Y.; Wong, S.C. Intelligent Transportation Systems, IEEE Transactions on; Year: 2012, vol. 13, Issue: 4; pp. 1727-1737, DOI: 10.1109/TITS.2012.2203122.*

Near real time vehicle tracking using GIS; Joshi, N.; Tripathy, A.K.; Sawant, S.; Patel, T.; Waghmare, S.; Clusher, B. Technologies for Sustainable Development (ICTSD), 2015 International Conference on; Year: 2015 pp. 1-6, DOI: 10.1109/ICTSD.2015.7095912.*

Evaluation of a mapping strategy based on smooth arc splines for different road types; Brummer, S.; Janda, F.; Maier, G.; Schindler, A.; Intelligent Transportation Systems—(ITSC), 2013 16th International IEEE Conference on; Year: 2013 pp. 160-165, DOI: 10.1109/ITSC.2013.6728227.*

Real-time urban traffic monitoring with global positioning system-equipped vehicles; Shi, W.; Liu, Y. Intelligent Transport Systems, IET; Year: 2010, vol. 4, Issue: 2; pp. 113-120, DOI: 10.1049/iet-its.2009.0053.*

* cited by examiner

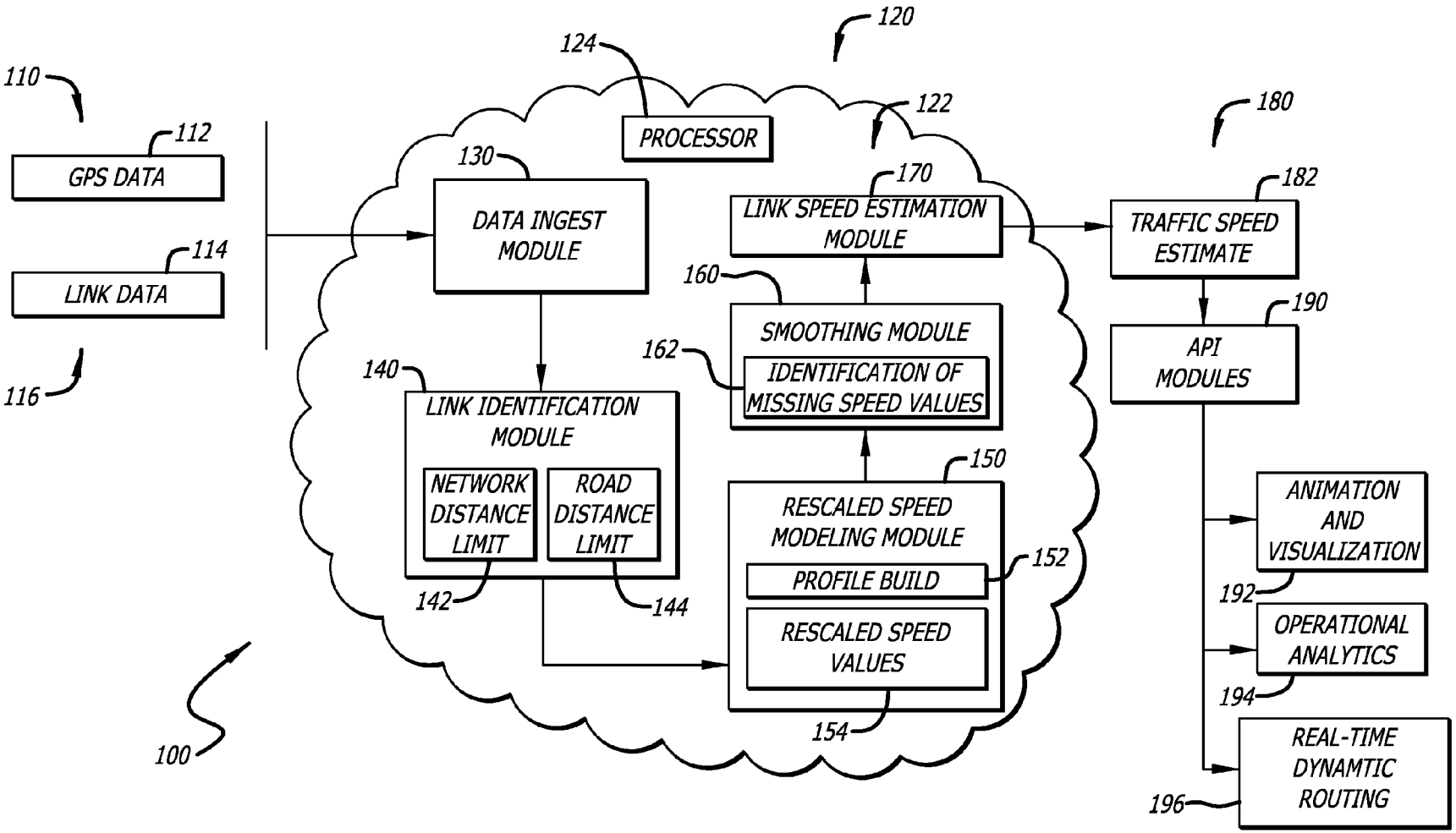
180
182
TRAFFIC SPEED ESTIMATE
190
API MODULES
ANIMATION AND VISUALIZATION
192
OPERATIONAL ANALYTICS
194
REAL-TIME DYNAMTIC ROUTING
196
120
122
170
LINK SPEED ESTIMATION MODULE
SMOOTHING MODULE
IDENTIFICATION OF MISSING SPEED VALUES
150
152
RESCALED SPEED MODELING MODULE
PROFILE BUILD
RESCALED SPEED VALUES
154
160
162
PROCESSOR
124
DATA INGEST MODULE
130
LINK IDENTIFICATION MODULE
NETWORK DISTANCE LIMIT
ROAD DISTANCE LIMIT
142
144
140
110
GPS DATA
112
LINK DATA
114
116
100

TRAFFIC SPEED ESTIMATION USING TEMPORAL AND SPATIAL SMOOTHING OF GPS SPEED DATA

CROSS-REFERENCE TO RELATED PATENT APPLICATIONS

This patent application claims priority to U.S. provisional application 61/841,450, filed on Jul. 1, 2013, the contents of which are incorporated in their entirety herein.

FIELD OF THE INVENTION

The present invention relates to traffic speed estimation. Specifically, the present invention relates to a system and method of estimating real-time traffic speed across multiple road segments in a transportation network at any time, by applying a spatial and temporal smoothing process to global positioning system (GPS) data to identify missing speed values in a set of collected GPS data.

BACKGROUND OF THE INVENTION

Existing approaches to traffic speed estimation endeavor to develop speed estimates across traffic networks representing large geographic areas. Each such network is comprised of inter-connected links. There are existing systems that attempt to utilize GPS data to develop such speed estimates, but obtaining complete link speed estimates is hindered by the sparseness of the input data—i.e., GPS data is typically available for only part of the links representing a larger transportation network, and only for part of the time. In other words, collected GPS data is incomplete, making it hard for these existing systems to accurately estimate traffic speed across inter-connected network segments.

An example of such a system is found in U.S. Pat. No. 7,557,730, which discloses systems and methods for automatically collecting, correcting, merging, and publishing information about traffic, transit, weather, public events and other information useful to travelers. This system collects data on a continuous basis at one or more locations and uses GPS receivers of users of a network of traffic segments to do so. One problem with such a collection methodology is that GPS data does not record direction of travel, and there is interference between segments on unrelated routes that are close in latitude and longitude. For at least these reasons traveler information across multiple segments cannot be accurately determined. This prior art solution attempts to match links so that it knows what direction the vehicle is traveling, thereby solving for information that is not provided in GPS data.

Such a prior art system does not address the problem of filling in missing speed information that is normally part of the GPS data set for all links at all times in a transportation network. This prior art solution is therefore focused on a framework for figuring out direction of travel, rather than compensating for the sparseness of speed information due to an incomplete set of GPS data. There is therefore a need in the art for a system and method of using collected GPS data to estimate vehicle speed across an entire network of road segments in real-time where the collected GPS data does not provide complete speed information.

BRIEF SUMMARY OF THE INVENTION

It is therefore one objective of the present invention to provide a system and method of filling in speed values missing from sets of GPS speed data. It is another objective of the present invention to provide a framework for determining real-time traffic speed over a plurality of links in a transportation network. It is a further objective of the present invention to determine real-time traffic speed over a plurality of links in a transportation network using missing speed values from GPS data sets.

The present invention provides a system and method of solving for missing speed data using known GPS data points and estimating traffic speed for all links in a transportation network at all time periods. Consider a transportation network for a large geographic area, such as the San Francisco Bay Area. This transportation network is represented as a collection of inter-connected road segments, or links. It is further objective of the present invention is to develop a link traffic speed estimation methodology that applies one or more data processing techniques to accomplish spatial and temporal smoothing of input data, represented by known GPS data points, to present a clearer picture of traffic speed across the entire transportation network. This methodology is embodied in data processing functions executed by one or more processors and embodied in one or more modules configured to model GPS data collected from a plurality of sources and arrive at real-time estimates of traffic speed for all segments at all times.

Complete link traffic speed estimates utilizing the data processing techniques disclosed herein have significant value and utility in the marketplace for consumer applications of such traffic speed data. For example, complete link traffic speed estimates are valuable for dynamic routing applications that aid in congestion alleviation and traffic planning for activities such as road maintenance, mass transit efficiency, and unforeseen event operations, for example during emergencies. Complete link speed estimates are also useful in providing accurate visualizations of congestion maps and animations thereof, and distribution or content generation using these visualizations, such as for example to media outlets and to web applications on mobile devices.

In the present invention, GPS data is acquired and ingested from one or more external sources. This GPS data is prepared for modeling to identify missing speed values in the dataset by applying a procedure to map known GPS data to road links, in a process known as snapping. It then determines neighboring links in the same link network using network distance and road distance limits on the link values. This is followed by steps in which the present invention uses initial data in the GPS data set to build a rescaled speed profile as well as a free-flowing speed estimate. The rescaled speed profile may be compressed via a clustering analysis to reduce storage requirements. The result is a model of rescaled speed that can be applied in real-time to fill in the missing speed values in an input data set by applying the snapping procedure to the GPS data, and then applying a temporal and spatial smoothing procedure to the known speed data using the rescaled speed values to arrive at sufficient estimates for the missing speed values. In cases where there is even less data, the profile-based method is used to infer missing speed values. Once this is accomplished, an accurate traffic speed can be estimated from the incomplete GPS speed data. In other words, the present invention utilizes observed information for one link to estimate neighboring links that are missing observed information, and applies this process to provide a traffic speed estimate for all links at all times.

Other objects, embodiments, features and advantages of the present invention will become apparent from the following description of the embodiments, taken together with the accompanying drawings, which illustrate, by way of example, the principles of the invention.

BRIEF DESCRIPTION OF THE SEVERAL VIEWS OF THE DRAWINGS

The accompanying drawings, which are incorporated in and constitute a part of this specification, illustrate several embodiments of the invention and together with the description, serve to explain the principles of the invention.

FIG. 1 is a block diagram of system components for a traffic speed estimation framework according to the present invention.

DETAILED DESCRIPTION OF THE INVENTION

In the following description of the present invention reference is made to the exemplary embodiments illustrating the principles of the present invention and how it is practiced. Other embodiments will be utilized to practice the present invention and structural and functional changes will be made thereto without departing from the scope of the present invention.

The present invention discloses a system and method of determining speed values missing from input data 110 such as collected GPS data 112, and a system and method of estimating link speed for all links 116 at all time periods using such missing speed values 162, in a traffic speed estimation framework 100. These are accomplished in a plurality of data processing functions, embodied in one or more modules 122 within a computing environment 120 that includes one or more processors 124 and a plurality of software and hardware components, the one or more modules 122 configured to identify links neighboring those represented in incoming sets of GPS data 112 and extrapolate observed speed data from the incoming sets of GPS data 112 to those neighboring links by building a profile 152 of what estimated average speed should be. This results in a rescaled speed value 154 that is then compressed together with the profile build 152 to form a model of rescaled speed that may then be snapped to one or more links 116 together with the known GPS data 112 to perform real-time processing. The present invention also applies a procedure to smooth out the incoming GPS data 112 by applying the modeled rescaled speed value 154 to identify appropriate values to fill in for the missing speed values 162. This produces a rescaled speed value that can be combined with known speed information from GPS data 112 to produce a traffic speed estimation 182 from incomplete GPS data 112 without needing further observed or collected GPS data 112. The present invention may also include a data ingest module 130 configured to receive input data from different sources, and one or more modules 190 configured to generate output data 180 for consumptive utility, as further described herein.

FIG. 1 is a block diagram of system components for such a traffic speed estimation framework 100 of the present invention. The traffic speed estimation framework 100 ingests existing GPS data 112 from at least one of a plurality of sources providing feeds of GPS data points containing speed information. Such GPS data 112 is represented by the notation:

<v, t, x, s>=<vehicle ID, time stamp, spatial coordinates (latitude and longitude), speed> where v=vehicle ID t=time stamp x=position s=vehicular speed, reported at time t at position x Data generated by geographical position systems (GPS) is typically sold in bulk, by the number of data points per day or per month. Generally, this data may be packaged in different ways—for example, in the form of "raw" or unprocessed probe data points, or in the form of processed probe data that reflects traffic speed on a roadway network. Regardless, the present invention contemplates that GPS data 112 ingested into the traffic speed estimation framework 100 the may be in either a processed or unprocessed form.

Input data 110 also includes link data 114, which is information defining one or more roadway links 116 of a segmented section of a transportation network. The traffic speed estimation framework 100 includes a link identification module 140 which performs a GPS mapping procedure which "snaps" the vehicle v at time t and location x to the most likely link, l (v, t, x) at an offset o (v, t, x). The output of such a procedure is GPS data 112 snapped to a link 116, and represented by the notation:

<l, t, s, v>=<link ID, time stamp, speed, vehicle id> where l=link ID t=time stamp s=vehicular speed, reported at time t at position x v=vehicle ID From this snapped GPS data 112, the traffic speed estimation framework 100 first calculates an initial speed estimate so:

$s_0$ (l, u)=median (s (v, t), for all v with l (v, t))

where u=a time period, and l and t belong to that time period.

Independently, a network neighbor calculation is performed to identify neighboring links e for each link l, represented generally by the notation:

<e1(l), e2(l), . . . en(l)>

This step needs to be performed only once for each network. There are two different types of network neighbor calculations: a network neighbor with a network distance limit 142, and a network neighbor with a road distance limit 144. For a network neighbor calculation with a network distance limit 142, the present invention seeks to determine the closest links 116 by degrees of separation, in terms of geographical connectivity. Parameters of this calculation are:

Maximum degrees of separation (e.g. 5)

Maximum number of neighborhood links (e.g. 10)

For each link l, the traffic speed estimation framework 100 performs a breadth-first-search (BFS) to traverse the geographical area comprising the links 116 of a transportation network and find all neighboring links (both upstream and downstream) within degree of separation=5 of connectivity from the downstream node of l. The present invention excludes links of different road classes from l, and maintains a maximum length (e.g., 10) of closest neighboring link candidates. Note that this step reduces the amount of data storage and computational capacity, and therefore improves processing speed.

For a network neighbor calculation with a road distance limit 144, the present invention seeks to determine the closest links 116 in the network within some fixed distance corresponding to roads in the network. Parameters are:

Maximum distance (e.g. 500 meters)

For each link l, the link identification module 140 of the traffic speed estimation framework 100 performs a breadth-first-search (BFS) to traverse the geographical area and find all neighboring links (both upstream and downstream) within all degrees, as long as the link is within the specified maximum distance value from the current link l. The present invention exclude links of different road classes from l.

Using the initial speed estimates $s_o$, a rescaled speed model 150 of the traffic speed estimation framework 100 builds a profile 152 and performs an empirical free-flow speed estimation. Data from the initial time period (e.g. a first week) is used as a "burn-in" period to produce this speed estimate, where:

n(l) is the # of speed values $s_0(l, t)$ over the burn-in period

Free flow speed is estimated by letting $s_{90}(l)$ be the 90th percentile of $s_0(l, u)$ over all u in the burn-in period. This effectively allows 10% of speed values $s_0(l, u)$ to be incorrectly high (due to wrong snapping, wrong speed read, etc.). It is to be noted that this free flow speed calculation disregards the posted speed limit, since free-flowing traffic speed is often not reflected by the posted speed limits. If n(l) is greater than 100 where s_ff_hat(l)=s90(l) then the present invention identifies s_ff_hat(l) as the nominal speed limit at the $90^{th}$ percentile, and uses this speed value as the estimated free-flow speed. In another embodiment, the free flow speed s_ff_hat(l) is a median value of s90(l') over l' in neighbor (l, degree of separation=5, number of links=10).

Additionally, the present invention rescales speed extensively at various steps by letting r(l, u)=s(l, u)/s_ff_hat(l) be the re-scaled version of the speed.

The traffic speed estimation framework 100 then builds a rescaled speed profile 154, using r(l, u) on the initial "burn-in" data as the building block. The rescaled speed profile 154 is a link profile represented by r-profile (l, tod) which equates to the hourly median over a 7-day period. It should be noted, however, that many links 116 have missing data points in the r-profile, especially during the night. Because of this, we also determine a global profile represented by a r-grand-median (tod) value as the median of r-profile (l, tod) across all links.

Once this rescaled speed profile 154 is constructed, the traffic speed estimation framework 100 performs a profile compression on links 116. This is because where the number of links 116 is large, storing the profile for all individual links 116 is costly. In such a case, the present invention extracts the representative profile by performing a cluster analysis, and storing only a pointer to a representative profile.

Profile-eligible links 116 are those with twelve or more hourly points (out of 24) in the profile. For profile-eligible links 116, the present invention performs a compression by running hierarchical clustering on re-scaled speed profiles 154 of those links 116 to divide the data into some set number of clusters (e.g. 64 clusters). The clusters are labeled such as from 1, . . . , 64, and a cluster median profile is calculated. For each link 116, only the cluster ID is stored. Additionally, median profiles are built for each road class (e.g. arterial, highway, etc.). For non-profile-eligible links 116, or those without twelve or more hourly points in the profile, the traffic speed estimation framework 100 simply uses the road class median profile.

Once the network neighbor links have been calculated and profiles constructed, the present invention applies the GPS snapping procedure described above in real time to snap known GPS points using the re-scaled speed 154 having the notation r. A smoothing module 160 of the traffic speed estimation framework 100 then applies a temporal and spatial smoothing procedure in real time to this data to fill in missing speed values 162.

Smoothing 160 is performed by applying different approaches to fill in those missing speed values 162. For each re-scaled speed $r_0(l, u)$ 154, the present invention proceeds in order by first examining observed data as candidates for the missing speed values 162. Where the rescaled speed $r_0(l, u)$ 154 is observed, the present invention concludes these are sufficient, terminates smoothing 160, and uses the observed values. This observed value, however, may include unwanted pedestrian or bus traffic. To mitigate this possibility, the smoothing module 160 may incorporate a Bayesian update by starting with the grand median value of r from profile building, and updating it based on the current observed value from the current and neighboring links. In doing so, current values are given more weights than older values, and current link values are given more weights than values for neighboring links.

If observed values are insufficient candidates, the smoothing 160 continues by examining a temporal median as a possible candidate for the missing speed values. Here, r(l, u)=median($r_0$(l, u'), where u'=u, u−1, u−2). If any of these temporal median values are observed, the present invention concludes these are sufficient, applies the temporal median as the missing speed values 162, and the smoothing 160 procedure is terminated. If they are not sufficient, the present invention then proceeds to examine a spatial-temporal median as a possible candidate for the missing speed values 162, where r(l, u) equates to a median($r_0$(l', u'), with l' representing a neighbor (l, degree of separation=5, link length=10), and u'=u, u−1, u−2). If any of these are observed, the present invention concludes these are sufficient, applies the spatial temporal median as the missing speed values 162, and terminates the smoothing module 160 procedure.

The smoothing module 160 procedure continues where the preceding approaches have not resulted in observations that satisfactorily fill in the missing speed values 162 missing from the GPS data 112. In a further approach of this smoothing 160 procedure, the present invention examines a link profile as providing possible candidates for the missing speed values 162. In this approach, the profile value is applied to the rescaled speed r(l, u) 154 so that r-profile is represented by the values (l, tod(u), dow(u)). If the profile value is observed, the traffic speed estimation framework 100 applies the link profile values as the missing speed values 162, and the smoothing 160 procedure is terminated. If they are not sufficient, the traffic speed estimation framework 100 proceeds to still another approach in which the global profile is examined. In this global profile approach, the rescaled speed r(l, u) 154 is equated to the grand median(tod(u), dow(u)). The global profiles are then assumed to be the speed values 162 missing from the GPS data 112.

Once smoothing 160 has been applied to known GPS data 112 to identify missing values 162, a final estimate of traffic speed 182 is calculated by a link speed estimation module 170. After smoothing 160, the resultant rescaled speed r(l, u) 154 does not contain any missing values 162. The output of the smoothing 160 procedure is re-scaled back to the original speed s to yield the final estimate of traffic speed from the GPS data set: s(l, u)=r(l, u)*s_ff_hat(l).

The link speed estimation module 170 of the traffic speed estimation framework 100 produces output data 180 representative of estimations 182 of traffic speed. These estimations 182 are distributed to one or more API (application programming interface) modules 190 for development of downstream uses of the output data 180, such as for example an animation and visualization module 192 that converts the output data 180 into animations and visualizations of traffic speed data for use on a graphical user interface. Another module 190 performs operational analytics using the output data 180 that are vital to management of a transportation network infrastructure 194, such as for example computing roadway network throughput, computing delay in vehicle-hours imposed by a traffic condition, and a degree of roadway utilization as a measure of productivity. Still another module 190 may be configured to utilize output data 180 for generating real-time dynamic routing 196.

Many applications of the output data 180 are contemplated. For example, filling in missing speed values 162 from collected GPS data 112 and estimating traffic link speed 182 for all links 116 at all time periods therefrom enables, as noted above dynamic, real-time routing 196 of all aggregated traffic in a network comprised of inter-connected road segments. Such dynamic routing 196 is useful for alleviating congestion on roadways and aiding traffic planners in real-time for improving work zone safety and efficiency in mass transit operations in response to current traffic speeds. Operational analytics 194 has applicability in congestion, mass transit, and work zone management, such analytics may also be useful in modeling real-time responses during disaster and emergency situations, such as for example traffic routing during tornado warnings in metropolitan areas. A complete link estimate 182 of traffic speed enables visualization 192 of traffic data that may be realized in a number of ways, such as in an animated map for distribution to media outlets or web applications, and may be specifically configured for display using a mobile device.

The systems and methods of the present invention may be implemented in many different computing environments 120. For example, they may be implemented in conjunction with a special purpose computer, a programmed microprocessor or microcontroller and peripheral integrated circuit element(s), an ASIC or other integrated circuit, a digital signal processor, electronic or logic circuitry such as discrete element circuit, a programmable logic device or gate array such as a PLD, PLA, FPGA, PAL, and any comparable means. In general, any means of implementing the methodology illustrated herein can be used to implement the various aspects of the present invention. Exemplary hardware that can be used for the present invention includes computers, handheld devices, telephones (e.g., cellular, Internet enabled, digital, analog, hybrids, and others), and other such hardware. Some of these devices include processors (e.g., a single or multiple microprocessors), memory, nonvolatile storage, input devices, and output devices. Furthermore, alternative software implementations including, but not limited to, distributed processing, parallel processing, or virtual machine processing can also be configured to perform the methods described herein.

The systems and methods of the present invention may also be partially implemented in software that can be stored on a storage medium, executed on programmed general-purpose computer with the cooperation of a controller and memory, a special purpose computer, a microprocessor, or the like. In these instances, the systems and methods of this invention can be implemented as a program embedded on personal computer such as an applet, JAVA® or CGI script, as a resource residing on a server or computer workstation, as a routine embedded in a dedicated measurement system, system component, or the like. The system can also be implemented by physically incorporating the system and/or method into a software and/or hardware system.

Additionally, the data processing functions disclosed herein may be performed by one or more program instructions stored in or executed by such memory, and further may be performed the by one or more modules configured to carry out those program instructions. Modules are intended to refer to any known or later developed hardware, software, firmware, artificial intelligence, fuzzy logic, expert system or combination of hardware and software that is capable of performing the data processing functionality described herein.

The foregoing descriptions of embodiments of the present invention have been presented for the purposes of illustration and description. It is not intended to be exhaustive or to limit the invention to the precise forms disclosed. Accordingly, many alterations, modifications and variations are possible in light of the above teachings, may be made by those having ordinary skill in the art without departing from the spirit and scope of the invention. It is therefore intended that the scope of the invention be limited not by this detailed description. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

The invention claimed is:

1. A method of determining real-time traffic speed over a plurality of links in a transportation network, comprising:

ingesting collected global positioning system (GPS) data from one or more sources and link data representing one or more links forming a transportation network;

processing the collected GPS data within a computing environment comprised of hardware and software components and a plurality of data processing functions executed by at least one processor and configured to fill in speed values missing from GPS data, by:

initiating a model of rescaled speed estimation by mapping the collected GPS data to the to one or more links comprising a transportation network, identifying a set of closest links neighboring those to which GPS data is mapped, and calculating an initial speed estimate;

building a first profile representing an estimate of free-flow speed from the collected GPS data mapped to the set of closest links, the first profile representing a free-flow speed estimate and enabling a rescaling of speed across all the links, and building a second profile of rescaled speed over a specified initial period by extrapolating observed speed data from the GPS data to the set of closest neighboring links to develop a rescaled speed value;

compressing the rescaled speed value with the first profile representing an estimate of free-flow speed to form the model of rescaled speed estimation from the collected GPS data mapped to the one or more links;

smoothing the collected GPS data and the model of re-scaled speed estimation to supply missing values among the collected GPS data, by applying a plurality of different values of rescaled speed and comparing the different values of rescaled speed with collected values relative to at least one link l and at least one time period u; and estimating a link speed for all links in the transportation network at all time periods and generating output data representative of the link speed.

2. The method of claim 1, wherein the collected GPS data is processed probe data that reflects traffic speed on a transportation network.

3. The method of claim 1, wherein the identifying a set of closest links neighboring those represented in incoming GPS data sets further comprising performing a network neighbor calculation with a network distance limit to determine the closest links by degrees of separation by traversing a geographical area comprising the one or more links of the transportation network, locating all neighboring upstream and downstream links within a specified degree of separation of connectivity from a downstream node l, excluding links of different road classes from l, and maintaining a maximum length of closest neighboring link candidates.

4. The method of claim 1, wherein the identifying a set of closest links neighboring those represented in incoming GPS data sets further comprising performing a network neighbor calculation with a road distance limit to determine the closest links in the network within a fixed distance by traversing a geographical area comprising the one or more links of the transportation network, locating all neighboring upstream and downstream links within a specified maximum distance value from a current link l, and excluding links of different road classes from l.

5. The method of claim 1, wherein the smoothing the collected GPS data and the model of re-scaled speed estimation further comprises applying a Bayesian update by starting with a grand median of a rescaled speed value, and updating the grand median of the rescaled speed value based on a current observed value from current and neighboring links.

6. The method of claim 1, wherein the smoothing the collected GPS data and the model of re-scaled speed estimation further comprises examining a temporal median as a possible candidate for a missing speed value.

7. The method of claim 1, wherein the estimating a link speed for all links in the transportation network at all time periods and generating output data representative of the link speed further comprising re-scaling a resultant speed value back to the initial speed estimate to yield the final estimate of the link speed.

8. The method of claim 1, wherein the generating output data representative of the link speed further comprises providing link speed estimates to enable at least one of real-time dynamic routing of all aggregated traffic in a transportation network comprised of inter-connected road segments, performance of operational analytics for roadway infrastructure management, visualization of traffic data on a user interface.

9. A method of filling in speed values missing from GPS data for a determination real-time traffic speed over a plurality of links in a transportation network, comprising:

determining an initial link speed estimate from collected GPS data mapped to one or more links comprising a transportation network;

calculating at least one set of neighboring links using a network distance limit to identify the at least one set of neighboring links at least within a specified degree of separation and a road distance limit to identify the at least one set of neighboring links within a fixed distance along a link;

generating a model of re-scaled speed estimation from the collected GPS data mapped to the one or more links, by:

estimating a free-flow speed using the initial link speed estimate, and re-scaling the initial link speed estimate using the free-flow speed;

building a rescaled speed profile comprised of a link profile represented by an hourly median value over a specific period of time for a particular link, a global profile represented by a median value across all links in the one or more links;

extracting a representative profile by performing a cluster analysis on re-scaled speed profiles, by calculating a cluster median profile and building a median profile for each road class for profile-eligible links;

snapping known GPS data to the one or more links using the re-scaled speed value; and smoothing the collected GPS data by mapping the model of the re-scaled speed estimation to the one or more links comprising the transportation infrastructure network by applying a plurality of different values of re-scaled speed estimation for each observation of a link l, and comparing those different values with collected GPS data relative to at least one link l and at least one time period u.

10. The method of claim 9, wherein the collected GPS data is processed probe data that reflects traffic speed on a transportation network.

11. The method of claim 9, wherein the network distance limit determines the closest links by degrees of separation by traversing a geographical area comprising the one or more links of the transportation network, locating all neighboring upstream and downstream links within a specified degree of separation of connectivity from a downstream node l, excluding links of different road classes from l, and maintaining a maximum length of closest neighboring link candidates.

12. The method of claim 9, wherein the road distance limit determines the closest links in the network within a fixed distance by traversing a geographical area comprising the one or more links of the transportation network, locating all neighboring upstream and downstream links within a specified maximum distance value from a current link l, and excluding links of different road classes from l.

13. The method of claim 9, wherein the extracting a representative profile by performing a cluster analysis on re-scaled speed profiles further comprises applying a road class median profile for non-profile-eligible links

14. The method of claim 9, wherein a profile-eligible link is a link with at least twelve hourly data points in its profile.

15. The method of claim 9, wherein the smoothing the collected GPS data and the model of re-scaled speed estimation further comprises applying a Bayesian update by starting with a grand median of a rescaled speed value, and updating the grand median of the rescaled speed value based on a current observed value from current and neighboring links.

16. The method of claim 9, wherein the smoothing the collected GPS data and the model of re-scaled speed estimation further comprises examining a temporal median as a possible candidate for a missing speed value.

17. A link speed estimation system, comprising:

a plurality of input including collected GPS data mapped to one or more links comprising a transportation network;

a plurality of data processing modules, executed by at least one processor within a computing environment, and configured to supply missing speed values among the collected GPS data by utilizing observed information from one link to estimate neighboring links without observed information, the plurality of data processing modules including a preparation module configured to model a re-scaled speed estimation from the collected GPS data mapped to the one or more links by locating a set of closest neighboring links to the one or more links to which collected GPS data is mapped, build a profile of rescaled speed for collected GPS data over a specified initial period at a link and a time period, and perform a cluster analysis to extrapolate observed speed data from the collected GPS data to the set of closest neighboring links to develop a rescaled speed value, and a smoothing module configured to process the collected GPS data by mapping the model of the re-scaled speed estimation to the one or more links comprising the transportation infrastructure network, apply a plurality of different values of re-scaled speed estimation for each observation of a link l, and compare those different values with collected GPS values relative to at least one link l and at least one time period u; and an estimation module configured to determine a link speed estimate for all links 1 in the transportation network at all time periods u, wherein output data generated by the estimation module enables dynamic, real-time routing information for traffic across the one or more links of the transportation network.

18. The link speed estimation system of claim 17, wherein the dynamic, real-time routing information comprises at least one instruction for alternate routing of traffic across the transportation network in response to an increase or decrease in the link speed estimate for any link l at any time period u.

19. The link speed estimation system of claim 17, wherein the dynamic, real-time routing information is used to generate traffic flow data for visualization on an animated map.

20. The link speed estimation system of claim 17, wherein the output data is provided via a third-party application for visualization on in-vehicle telematics equipment.

21. The link speed estimation system of claim 17, wherein the output data is provided via a third-party application for visualization on a mobile device.

22. The link speed estimation system of claim 17, wherein the output data is provided via a third-party application for media distribution.

23. The link speed estimation system of claim 22, wherein the dynamic, real-time routing information is used for traffic planning and operational analytics for transportation infrastructure management encompassing the one or more links.

24. The link speed estimation system of claim 22, wherein transportation infrastructure management includes at least one of planning for congestion alleviation for the one or more links, and efficient operation of mass transit vehicles for the one or more links.

25. The link speed estimation system of claim 12, wherein the GPS data is processed probe data that reflects traffic speed on a transportation network.

* * * * *